United States Patent [19]

Cherry

[11] Patent Number: 4,957,027

[45] Date of Patent: Sep. 18, 1990

[54] VERSATILE NONELECTRIC DEARMER

[75] Inventor: Christopher R. Cherry, La Plata, Md.

[73] Assignee: The United States of America as represented by the Secretary of the Navy, Washington, D.C.

[21] Appl. No.: 415,758

[22] Filed: Oct. 2, 1989

[51] Int. Cl.[5] ..... F41A 19/57

[52] U.S. Cl. ..... 89/1.14; 86/50; 89/1.1

[58] Field of Search ..... 89/1.1, 1.14; 86/50

[56] References Cited

U.S. PATENT DOCUMENTS

| | | | |
|---|---|---|---|
| 2,491,516 | 12/1949 | Aggot et al. | 89/1.14 |
| 2,900,972 | 8/1959 | Marsh et al. | 89/1.14 |
| 2,924,147 | 2/1960 | Bohl et al. | 89/1.14 |
| 3,620,121 | 11/1971 | Olsen | 89/1.14 |
| 3,744,369 | 7/1973 | Marziano et al. | 89/1.14 |
| 3,991,649 | 11/1976 | Patrichi | 89/1.14 |
| 4,046,055 | 9/1977 | McDanolds et al. | 86/50 |
| 4,062,112 | 12/1977 | Lake | 86/50 |
| 4,169,403 | 10/1979 | Hanson | 86/50 |
| 4,457,204 | 7/1984 | Blomgren | 89/1.14 |
| 4,664,033 | 5/1987 | Burkdoll et al. | 89/1.14 |
| 4,722,279 | 2/1988 | Yunan | 102/275.4 |
| 4,779,511 | 10/1988 | Proctor et al. | 86/50 |
| 4,809,610 | 3/1989 | Florin | 102/275.2 |

*Primary Examiner*—David H. Brown

*Attorney, Agent, or Firm*—John D. Lewis; Kenneth E. Walden

[57] ABSTRACT

A versatile, dearmer using small arms cartridges that is low cost, may be reusable, and can employ various types of destructive projectiles including water, clay, shot and steel slugs. A novel feature is a shock tube firing circuit which, when combined in a multiple barrel embodiment, produces multiple projectiles with a high degree of firing simultaniety.

19 Claims, 4 Drawing Sheets

VERSATILE NONELECTRIC DEARMER

STATEMENT OF GOVERNMENT INTEREST

The invention described herein may be manufactured and used by or for the Government of the United States of America for governmental purposes without the payment of any royalties thereon or therefor.

FIELD OF INVENTION

This invention relates to the field of devices for disarming bombs and ordnance. In particular, an explosive, disposable dearmer with the versatility to destroy a target with various destructive mediums is herein disclosed. This dearmer is low cost, readily constructed from off-the-shelf hardware, utilizes a small caliber charge such as a 12-gauge shotgun shell, and is initiated with shock tube.

A related application by inventor Christopher R. Cherry entitled Nonvolatile, Fast Response Wire Cutter, filed Oct. 2nd, 1989, and serialized No. 07/415,736, teaches a wire cutter employing similar initiation techniques as those disclosed herein.

BACKGROUND OF THE INVENTION

Various devices are used in the explosive ordnance disposal (EOD) and bomb squad environments to disable improvised explosive devices (IED's). These include propellant driven projectiles initiated by electric squids or time fuse. Hanson, U.S. Pat. No. 4,169,403 issued Oct. 2, 1979, uses several grams of black powder, electrically initiated to propel a liquid out of a barrel, to accomplish destruction of the IED. Electrically operated dearmers require electric squibs as a first fire material, engender a safety hazard when exposed to electromagnetic radiation or static electricity, and require a power source for initiation. Generally, with multiple barrel electric dearmers, the firing simultaniety is relatively poor due to the thermal heating and transfer differences in the bridgewires.

Other dearmers known in the EOD art include explosively operated devices that propel various projectiles or missiles at an IED to destroy or disable them. These generally are initiated by time fuse or detonating cord. The detonating cord is classed as explosives. Proctor, U.S. Pat. No. 4,779,511 discloses a disposable dearmer using a 50 caliber slug and explosive charge which may be electronically or explosively initiated. The novel feature of Proctor is the ability to position the slug at various positions within the barrel, thus varying muzzle velocity to accommodate different targets.

Other dearmers are known in the art that use 50 caliber small arms cartridges either electrically or explosively initiated to dearm IED's. Another such device uses a 12-gauge cartridge and is modified by using a larger charge than is available in commercial shotgun shells. This device uses an electric operated pyrotechnic squib affixed to the shotgun shell to initiate the propellant.

Other devices affix a length of time fuse or detonating cord to the rear of small arms cartridges to initiate the propellant. In these devices, the detonating cord initiates the cartridge primer while the time fuse usually initiates the propellant directly.

All known small arms cartridge dearmers require specially configured modified cartridges to receive either electric squibs or time fuses, those using detonating cord require a blasting cap to initiate the detonating cord and the others a power source. There are no known dearmers using standard off-the-shelf small arms cartridges to destructively disable an IED.

Another requirement extant in the EOD environment is a dearmer with a capability to fire multiple explosive slugs or missiles into an IED at different entry points with a high degree of simultaniety. As IED's increase in sophistication, the simultaniety requirement often demands closer and closer functioning times of the missile disruptors.

SUMMARY OF THE INVENTION

The features and advantages of the present invention are obtained by using shock tube to initiate a mechanical firing circuit to fire one or more standard load, off-the-shelf, small arm cartridges, or a modified cartridge through one or more barrels to disarm an IED. The small arms cartridge may be employed with a standard projectile or shot load, or the small arms cartridge can be used without the shot or bullet to propel various missiles such as clay or a liquid, to act as the disabling projectiles.

An object of the instant invention is to teach a dearmer that can either perform circuit disruption or general destruction of an IED.

Another object of this invention is to teach a dearmer that can be assembled with readily available materials.

Still another object of the present invention is to teach a dearmer that can be assembled in a multiple barrel embodiment and fire more than one projectile or missile into an IED with a high degree of simultaniety.

A further object of the instant invention is to teach an IED that can be fired with nonexplosive shock tube.

Still another object of the present invention is to teach a dearmer that can function with various small arms cartridges as the primary explosive.

Another object of the present invention is to teach a dearmer that is low cost and can be either disposable or reusable, as the operating environment requires.

Still another embodiment of the instant invention is a dearmer that can function in a limited space operating environment, is small and lightweight, and can be assembled with a simple, quick-connect system.

Another object of the present invention is to teach a small arms cartridge dearmer that can employ various projectiles to disable an IED including, but not limited to water, other liquids, steel or lead shot, steel slugs, lead slugs, frangible projectiles, clay or slugs constructed from ultra-hard alloys or materials.

Other objects, advantages, and novel features of the present invention will become apparent from the following detailed description of the invention when considered in conjunction with the accompanying drawings.

DETAILED DESCRIPTION OF THE INVENTION

Figure 1:
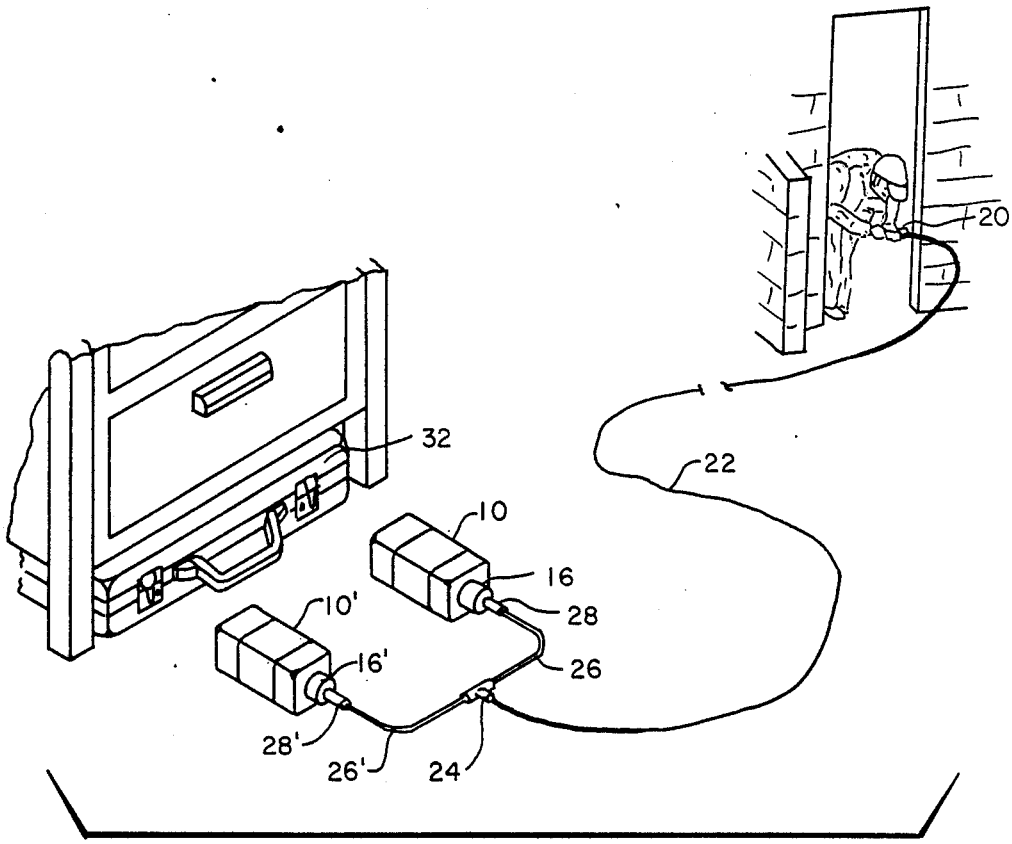
FIG. 1 is a graphic showing operation of a multiple-barrel dearmer.

Turning now to FIG. 1, a multiple barrel configuration of Applicant's dearmer is shown in operation. Therein an EOD technician is shown initiating a fuse lighter 20 which in turn initiates an energy transfer in shock tube 22 which bifurcates in shock tube tee connector 24 where the transmitted energy in shock tube 24 is substantially simultaneously transferred to a pair of firing shock tubes 26 and 26' of substantially equal length. The energy is then transferred to a pair of mechnical piston driven firing assemblies 28 and 28', causing cartridges 30 (not shown in FIG. 1) to explode, thus actuating the dearmer body assemblies 10 and 10'. The dearmer body assemblies then fire an appropriate slug, missile or projectile into a respective portion of IED 32, thus destroying or rendering it safe.

Figure 2:
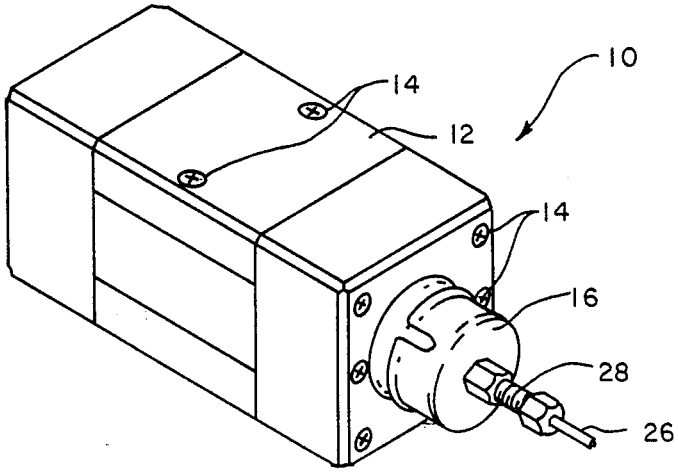
FIG. 2 is a pictorial representation of a dearmer body assembly of a single-barrel embodiment.

FIG. 2 shows a pictorial representation of a dearmer body assembly 10. The housing 12 can be constructed of any appropriate material that provides support for a barrel and can create a stable platform to hold the dearmer in unmoving position in firing proximity to IED 32. The housings actually built and tested by Applicant, were of various materials with the embodiment shown in FIG. 2 constructed of plywood. Wood screws 14 held the wood pieces together forming a rectangle that might rest firmly in stable position on any of its four sides. Housing 12 has a hollow cylindrical opening on either end to receive a barrel. A breech cap 16 is shown covering the barrel hole in breech end of housing 12 in FIG. 2. This breech cap 16 is threaded to the dearmer barrel 40 (not shown in FIG. 2), and encompasses the small arm cartridge used as a propellant in the dearmer. A firing assembly 28 is threadably affixed to breech cap 16, in physical alignment with the primer contained in the small arms cartridge 30, which is held in position by the breech cap. It should be noted that in embodiments using center fire cartridges, the firing assembly 28 would be centered in breach cap 16 while rim fire cartridges would require the firing assembly to be offset so as to properly align with the rim fire cartridge primer 34.

Figure 3:
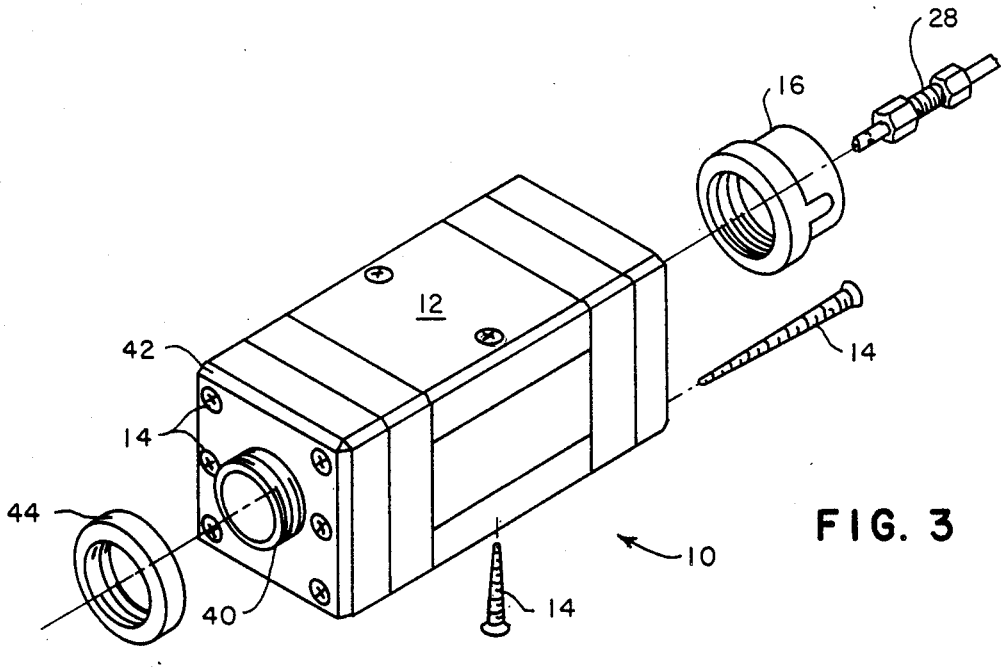
FIG. 3 is an exploded parts diagram of the dearmer body assembly of FIG. 2.

FIG. 3 is an exploded parts diagram of the dearmer body assembly wherein barrel 40 is shown protruding through the firing end of dearmer body assembly 10. A steel plate 42 is shown affixed to the firing end of housing 12 to act as a recoil plate and the threshold firing end of barrel 40 is retained in fixed position by a barrel retaining ring 44. The recoil plate is required on embodiments using relatively large caliber small arms cartridges but no recoil plate would be required should the embodiment employ a small caliber such as a 38/357 caliber or smaller cartridge. No recoil plate would be required with any caliber should the device be intended for single use. If the housing assembly were constructed of metal rather than wood, as shown in FIG. 3, then again no separate recoil plate 42 would be required. The recoil plate is simply to keep the muzzle recoil from damaging housing 12 upon operation.

The easiest construction of dearmer body assembly 12 is to simply construct a rectangular box with barrel holes cut in either end to support and align barrel 40 axially within the body assembly.

Figure 4:
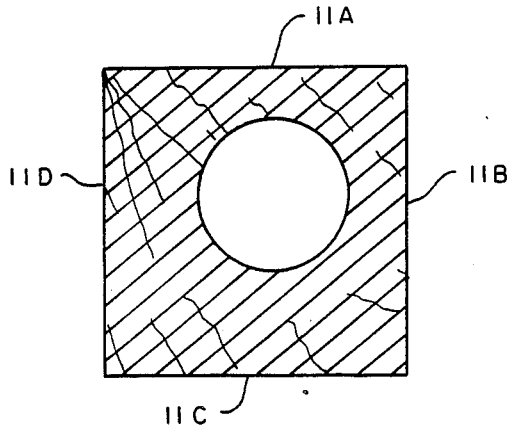
FIG. 4 is a pictorial of a body assembly having the barrel offset from axial alignment.

FIG. 4 is a pictorial of a body assembly having the barrel offset from axial alignment resulting in the barrel having different elevations depending upon which face of the body assembly is supporting the structure. If the barrel 40 is too low when assembly 12 is resting on side 11*a*, the device can be rotated until the assembly 12 is resting on side 11*b* which raises the barrel from the resting surface incrementally. Likewise, sides 11*c* and 11*d* provide incrementally higher elevations of barrel 40.

If the principle IED were known before construction of the dearmer, e.g., a 2-inch pipe bomb, body assembly 12 could be constructed with at least one side exactly elevating the barrel for destruction or disablement of these type devices.

Figure 5:
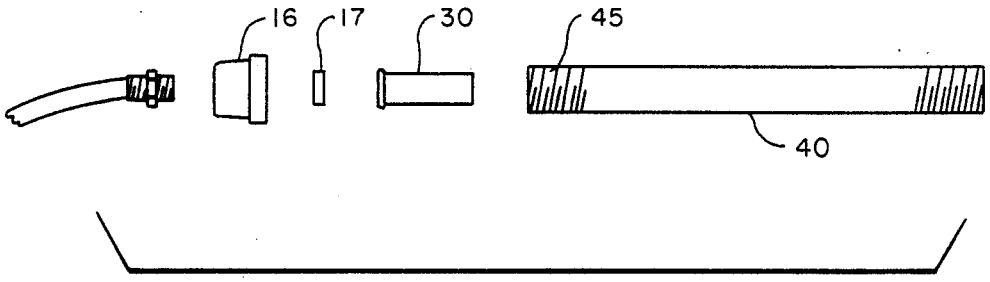
FIG. 5 is an exploded view of the firing train of the dearmer shown in FIG. 2.
Figure 9:
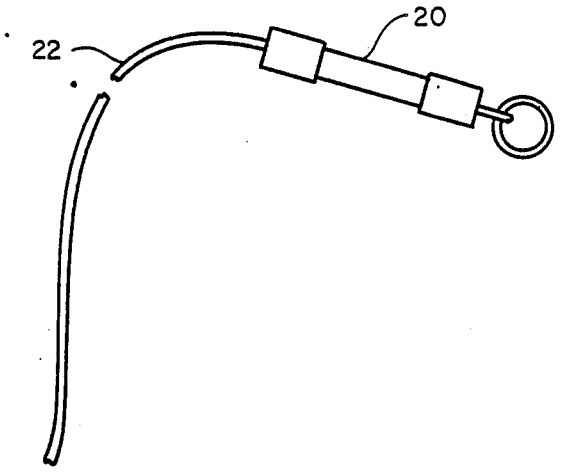
FIG. 9 is a pictorial of a military M-60 fuse igniter which may be used to initiate operation of the dearmer of FIG. 1.

FIG. 5 shows an exploded view of the firing train of a loaded dearmer body. Therein barrel 40 is threaded on the breach end 45 to threadably receive end cap 16. A washer 17 resides within end cap 16 to snugly and urgingly retain cartridge 30 within the breech end of barrel 40 when end cap 16 is threaded on threaded end 45. Firing assembly 28 is a shock tube actuated mechanical firing circuit which is connected to an unspecified length of shock tube 26. This shock tube 26 whould run to a common energy initiator such as an M-60 fuse lighter, FIG. 9, numeral 20, an EBW bridge head, commercial shock tube initiator, or various other percussion igniters such as standard blasting caps, in a single barrel configuration.

Figure 6:
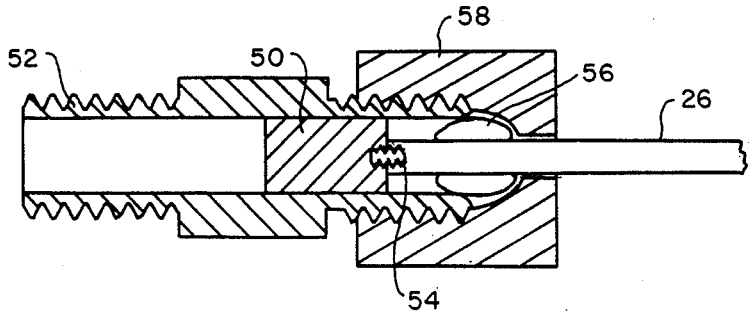
FIG. 6 is a cut away view of the firing assembly 28 of the dearmer of FIG. 2.

Turning now to FIG. 6, cut away perspective of the shock tube initiated mechanical firing circuit 28 shows a piston 50 slidably disposed within a piston barrel assembly 52. Piston 50 was constructed from standard five/-thirty seconds inch brass stock in the preferred embodiment and functions as the firing pin to initiate firing of cartridge 30. Barrel 52 was a standard, off-the-shelf, one-eighth inch, high pressure brass compression union, available commercially from neighborhood hobby shops. The union comprising piston barrel assembly 52 was machined to receive piston 50 is sliding engagement. Piston 50 was attached to shock tube 26 with a threaded stud 54. A standard one-eighth inch brass ferrule 56 is swaged onto shock tube 26 to frictionally engage a tubing nut 58 that holds the shock tube 26 and piston 50 in operative position within piston barrel assembly 52. Upon initiation of shock tube 26, piston 50 is separated from shock tube 26 by forcibly stripping the shock tube from the threaded stud 54 and accelerating the piston 50 down barrel assembly 52 to fire primer 34 on cartridge 30.

A complete and detailed description of using shock tube to perform mechanical motion, including apparatus for firing small arms cartridges, is contained in an application for patent entitled Nonvolatile, Fast Response Wire Cutter filed Oct. 2nd, 1989 by this invertor and serialized No. 415,731. This application contains a discussion of the features and advantages of using shock tube to obtain simultaniety of multiple mechanical work functions and said application is hereby incorporated by reference.

The increased simultaniety of the dearmer of the present invention, exhibited in multibarrel configurations, is considered an advantage and feature of this invention.

Figure 7:
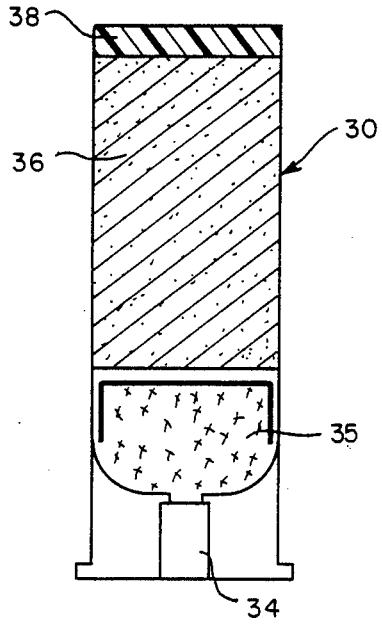
FIG. 7 is a cut away view of a modified shotgun shell used in the dearmer of FIG. 1.

Another advantage of the instant invention is this dearmer may be used with standard load cartridges and shotgun shells or specially configured modified cartridges. FIG. 7 is a pictorial of a modified 12-gauge shotgun shell 30. Therein a standard factory-loaded primer 34 is shown in position to ignite a standard powder load 35. Many different types of cartridges may be satisfactorily used in various embodiments to Applicant's dearmer. FIG. 7 was one modified for use in an embodiment of Applicant's dearmer used to fire a liquid to disrupt and destroy a particular type of IED. Therein the shot was removed and the shell was packed with modeling clay 36. The shell was then sealed with a layer of hot melt glue 38 which acts as a seal and crimp, resulting in higher pressures generated from shell 30 upon firing. This particular shell performed well in a version of Applicant's dearmer used as a water cannon.

Figure 8:
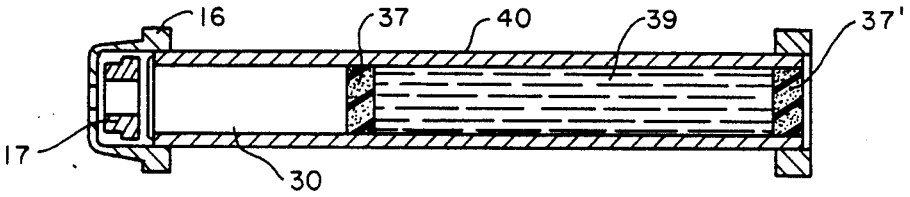
FIG. 8 is a barrel loading diagram for use in dearmers using the cartridge of FIG. 7 to propel a water progectile.

Turning now to FIG. 8, a barrel assembly 40 loaded as a water cannon is illustrated. Therein, breach cap 16 is threadably urging washer 17 against cartridge 30 which is a standard shotgun shell with modeling clay substituted for the standard shot and sealed into the cartridge case with a layer of hot melt glue. Within barrel 40 operatively spaced in front of shell 30 is a sealing cylinder 37 constructed from closed cell foam. This sealing cylinder in conjunction with sealing cylinder 37' sealingly encapsulates a quantity of water or other liquid 39 to be used as a projectile for destruction of target 32. It should be noted that the modeling clay 36 may be used in an open barrel embodiment whereby the modeling clay functions alone as the projectile, if target 32 be of the appropriate type. In this configuration, the clay acts as a columinated disruptor with a standoff capability.

Many and varied adaptations and embodiments are possible depending upon the parameters needed to disable and destroy particular targets. Applicant has built and tested embodiments using a 38 special small arms cartridge, various shotgun shells, and other commercial caliber ammunition. Likewise, embodiments have been constructed to fire water projectiles, steel slugs, semi-solid projectiles such as clay, frangible projectiles, and standard shot and small arms slugs. Obviously, many many modifications and variations of the present invention are possible in light of the above teachings. It is therefore to be understood that, within the scope of the appended claims, the invention may be practiced otherwise than as specifically described.

What is claimed is:

1. A versatile dearmer using small arms cartridges comprising:

a barrel having a receiver sized to receive a small arms cartridge and a muzzle end; and a housing to stabilize and hold said barrel in stable firing position; and a mechanical firing circuit comprised of a piston shaped on one end as a firing pin slidably mounted in a tubular guide operatively positioned to fire a small arms cartridge loaded in the receiving end of said barrel; and an unspecified length of shock tube to initiate movement of the piston in said mechanical firing circuit; and an initiator to initiate energy transfer in said unspecified length of shock tube.

2. A dearmer according to claim 1 wherein said barrel is sized to receive a commercial shotgun shell.

3. A dearmer according to claim 1 wherein said barrel is sized to receive a commercial 38 special/357 magnum pistol cartridge.

4. A dearmer according to claim 1 wherein said mechanical firing circuit is operatively sized to fire a military 50 caliber small arms cartiridge.

5. A dearmer according to claim 1 wherein said shock tube initiator is a military M-60 fuse lighter.

6. A dearmer according to claim 1 wherein said housing is constructed of wood.

7. A dearmer according to claim 6 further defined by a metal plate mounted on said housing on the end supporting the muzzle end of said barrel in such a manner as to provide recoil support to the firing end of said barrel.

8. A dearmer according to claim 6 whrein said wood housing is rectangular in shape and has barrel mounting holes to support a barrel in axial alignment with said housing.

9. A dearmer according to claim 8 wherein the barrel alignment holes are offset from the axial alignment of said wood housing whereby the elevation of said barrel would be controlled by selecting which of the four sides of said housing supported the device when the device was placed in operating position.

10. A dearmer according to claim 9 wherein the small arms cartridge loaded in said barrel is a modified shotgun shell firing a cylinder of modeling clay instead of shot.

11. A dearmer according to claim 9 wherein said barrel is sized to receive a 12-gauge commercial shotgun cartridge.

12. A dearmer according to claim 11 further defined by a pair of liquid sealing rings mounted in said barrel in a manner whereby a liquid is trapped within the barrel to act as a water projectile when the device is fired.

13. A dearmer according to claim 12 wherein said liquid sealing rings are closed cell plastic.

14. A versatile dearmer using small arms cartridges comprising:

a plurality of barrels having receiver ends operatively sized to receive a particular caliber or gauge of small arms cartridge and firing ends; and a housing for each of said barrels to stabilize and hold the firing ends of said barrels in firing position toward an improvised explosive device to be dearmer, and a shock tube initiated firing circuit operatively mounted in firing proximity to the receiver ends of each of said barrels; and a shock tube connector capable of connecting said plurality of barrels to a single section of shock tube; and a shock tube initiator to initiate energy transfer in said single section of shock tube.

15. A versatile dearmer according to claim 14 further defined by projectiles operatively spaced within each of said barrels whereby firing of the cartridges in the receiving end of said barrels causes the projectiles to accelerate and exit the firing ends of said barrels.

16. A dearmer according to claim 14 wherein said shock tube connector is operatively mounted so that the shock tube connecting said shock tube connector and said barrels are substantially the same length to provide a high degree of firing simultaniety between said barrels.

17. A versatile dearmer comprising:

a rectangular wooden housing having a breach and receiving end, each containing a barrel support hole in axial alignment with the opposing hole; and a barrel operatively sized to receive a 12-gauge shotgun shell having a breach end and a firing muzzle end operatively mounted within said wooded housing; and a shotgun shell disposed within the breach end of said barrel; and a breech cap containing a center hole threadably attached to the breech end of said barrel to urgingly retain the 12-gauge shotgun shell in firing position within said barrel; and a shock tube initiated mechanically operated firing device threadably attached to the hole in said breech cap; and a length of shock tube having an initiation end, and a firing end attached to said firing device; and a shock tube initiator attached to the initiator end of said shock tube to initiate energy transfer in said length of shock tube.

18. A dearmer according to claim 17 further defined by a washer sealingly mounted between said breech cap and said barrel.

19. A dearmer according to claim 17 wherein said shock tube initiated mechanically operated firing device is comprised of a piston sliding down a cylinder to enter the hole within said breech cap thereby striking the shotgun shell a firing blow.

* * * * *